US005935414A

United States Patent [19]

Sonnemans et al.

[11] Patent Number: 5,935,414

[45] Date of Patent: Aug. 10, 1999

[54] HYDROCRACKING AND HYDRODEWAXING PROCESS

[75] Inventors: Johannes Wilhelmus Maria Sonnemans, Soest; Franciscus Maria Nooij, Amersfoort, both of Netherlands; Jacques Francois Jeanne Grootjans, Leefdaal, Belgium

[73] Assignees: Akzo Nobel NV, Arnhem, Netherlands; Fina Research S.A., Belgium

[21] Appl. No.: 08/619,685

[22] PCT Filed: Oct. 7, 1994

[86] PCT No.: PCT/EP94/03323

§ 371 Date: Apr. 2, 1996

§ 102(e) Date: Apr. 2, 1996

[87] PCT Pub. No.: WO95/10578

PCT Pub. Date: Apr. 20, 1995

[30] Foreign Application Priority Data

Oct. 8, 1993 [EP] European Pat. Off. ..... 93202853

[51] Int. Cl.[6] ..... C10G 47/16

[52] U.S. Cl. ..... 208/58; 208/59; 208/60

[58] Field of Search ..... 208/58, 59, 60

[56] References Cited

U.S. PATENT DOCUMENTS

| | | | |
|---|---|---|---|
| 3,130,007 | 4/1964 | Breck | 23/113 |
| 3,293,192 | 12/1966 | Maher et al. | 252/430 |
| 3,449,070 | 6/1969 | McDaniel et al. | 23/111 |
| 3,702,886 | 11/1972 | Argauer et al. | 423/328 |
| 3,709,979 | 1/1973 | Chm | 423/328 |
| 3,758,402 | 9/1973 | Oleck et al. | 208/111 |
| 3,832,449 | 8/1974 | Rosinski et al. | 423/328 |
| 3,929,672 | 12/1975 | Ward | 252/455 |
| 4,016,218 | 4/1977 | Harg et al. | 260/671 |
| 4,016,245 | 4/1977 | Plank et al. | 423/323 |
| 4,046,859 | 9/1977 | Plank et al. | 560/412 |
| 4,076,842 | 2/1978 | Plank et al. | 739/414 |
| 4,347,121 | 8/1982 | Mayer et al. | 195/554 |
| 4,440,871 | 4/1984 | Lok et al. | 400/438 |
| 4,503,023 | 3/1985 | Breck et al. | 315/853 |
| 4,591,576 | 5/1986 | Chiang et al. | 502/65 |
| 4,600,498 | 7/1986 | Ward | 208/111 |
| 4,711,710 | 12/1987 | Chen | 938/214 |
| 4,743,354 | 5/1988 | Ward | 916/196 |
| 4,757,041 | 7/1988 | Oleck et al. | 502/65 |
| 4,789,654 | 12/1988 | Hirano et al. | 208/66 |
| 4,810,356 | 3/1989 | Grootjans et al. | 10/223 |
| 4,859,312 | 8/1989 | Miller | 208/111 |
| 4,872,968 | 10/1989 | Bowes | 87/197 |
| 4,913,798 | 4/1990 | Gortsema et al. | 208/111 |
| 4,917,789 | 4/1990 | Butler et al. | 208/89 |
| 4,921,594 | 5/1990 | Miller et al. | 208/51 |
| 4,961,836 | 10/1990 | Murphy | 320/121 |
| 5,284,573 | 2/1994 | LaPierre et al. | 208/89 |

FOREIGN PATENT DOCUMENTS

| | | | |
|---|---|---|---|
| 0 042 238 | 6/1981 | European Pat. Off. | C10G 65/12 |
| 0 189 648 | 11/1985 | European Pat. Off. | C10G 47/16 |
| 189 648 | 8/1986 | European Pat. Off. | 208/58 |
| 0 263 228 | 1/1987 | European Pat. Off. | C10G 65/12 |
| 0 233 169 | 2/1987 | European Pat. Off. | C10G 65/12 |
| 2 114 594 | 2/1983 | United Kingdom | C10G 47/16 |
| WO 92/03519 | 3/1992 | WIPO . | |

OTHER PUBLICATIONS

EP 279180 1988 Derwent Publications Ltd. Abstract—No Month Available.

Journal of Catalysis 86, pp. 24–31 (1984) TMA–Offretite. Relationship between Structural and Catalytic Properties by N.Y. Chen et al.—No Month Available.

*Primary Examiner*—Walter D. Griffin
*Assistant Examiner*—Nadine Preisch
*Attorney, Agent, or Firm*—Oliff & Berridge, PLC

[57] ABSTRACT

Process for reducing the wax content of wax-containing hydrocarbon feedstocks to produce middle distillate products including low freeze point jet fuel and/or low pour point and low cloud point diesel fuel and heating oil. The process involves contacting the feedstock with a hydrocracking catalyst containing a carrier, at least one hydrogenation metal component of Group VIB and Group VIII metals, and a large pore zeolite such as a Y type zeolite, in a hydrocracking zone in the presence of hydrogen at elevated temperature and pressure, and contacting the entire effluent from the hydrocracking zone with a dewaxing catalyst containing a crystalline, intermediate pore size molecular sieve selected from metallosilicates and silicoaluminophosphates in a hydrodewaxing zone in the presence of hydrogen at elevated temperature and pressure.

5 Claims, No Drawings

HYDROCRACKING AND HYDRODEWAXING PROCESS

BACKGROUND OF THE INVENTION

1. Field of the Invention

The invention relates to a process for reducing the wax content of wax-containing hydrocarbon feedstocks. More particularly, the invention relates to a process for converting wax-containing hydrocarbon feedstocks into high-grade middle distillate products including jet fuel having a low freeze point and/or diesel fuel and heating oil having a low pour point and a low cloud point.

2. Description of Related Art

Many liquid hydrocarbon feedstocks contain relatively high concentrations of straight chain and slightly branched chain aliphatic compounds having between 8 and 40 carbon atoms, commonly indicated as waxes. These compounds tend to crystallise on cooling of the hydrocarbon oil, a crystallisation which is quite frequently sufficient to hinder the flow of the liquid hydrocarbon and prevent it from being pumped or transmitted from one location to another. The temperature at which the hydrocarbon oil will not flow is commonly referred to as the "pour point." The temperature at which a cloud or haze of wax crystals is formed in the oil is commonly referred to as the "cloud point." These parameters are determined by way of standardised test procedures.

One way of converting such wax-containing feedstocks into high-grade products is by means of catalytic conversion, a process in which the waxes and other high-molecular weight hydrocarbon components are cracked in the presence of hydrogen to lower-molecular weight components. In this way middle distillates can be produced, and because of the ever increasing need for middle distillates, such as jet fuel, diesel fuel, and heating oil, it is of major importance to have good processes for their production, i.e., processes which effect efficient conversion of the objectionable high-molecular weight feedstock components to give middle distillate products with desirable properties.

Recently, such a process was put forward in U.S. Pat. No. 4,743,354. This document recommends a process for the preparation of middle distillates in which a waxy hydrocarbon feedstock of which a substantial proportion boils above 343° C. is subjected to dewaxing or hydrodewaxing and the effluent is subsequently subjected to hydrocracking. The dewaxing catalysts employed are compositions containing a binder and a crystalline, intermediate pore size molecular sieve, the pores of which are defined by 10-membered rings of oxygen atoms, such as silicalite, zeolites of the ZSM-5 family, silicoaluminophosphates, and the like; the dewaxing catalyst may be provided with at least one hydrogenation metal. The hydrocracking catalysts employed are compositions containing a carrier, a Group VIB metal component and/or a Group VIII metal component, and an acidic cracking component, such as silica-alumina in combination or not with a large pore zeolite, e.g., X zeolite, Y zeolite, LZY-82, and LZ-10. Thus, it is stated, middle distillate products are obtained which have a low freeze point in the case of jet fuel and a low pour point as well as a low cloud point in the case of diesel fuel and heating oil. The present invention has for its object to provide a process which improves on the one known from said US patent specification. More particularly, the invention has for its object to provide a process by means of which, while using similar types of catalysts to those known from the aforementioned patent specification, middle distillate products can be made which have a lower freeze point in the case of jet fuel and a lower pour point as well as a lower cloud point in the case of diesel fuel and heating oil.

It has been found that these objectives may be attained by making use of a process in which the feedstock is subjected to hydrocracking and the effluent from the hydrocracking step is then subjected to dewaxing or hydrodewaxing: in other words, the sequence of steps followed is the exact reverse of that known from the aforesaid patent specification.

SUMMARY OF THE INVENTION

In accordance with the foregoing, the invention provides a process for converting a wax-containing hydrocarbon feedstock containing a substantial proportion of hydrocarbonaceous material boiling above 343° C. into a middle distillate product having a reduced wax content compared with that of the feedstock, which process comprises (a) contacting the feedstock in the presence of hydrogen with a hydrocracking catalyst containing a carrier, at least one hydrogenation metal component selected from Group VIB and Group VIII of the Periodic Table, and a large pore zeolite having a pore diameter in the range of 0.7 to 1.5 nm, in a hydrocracking zone under conditions of elevated temperature and pressure (b) contacting the entire effluent from the hydrocracking zone in the presence of hydrogen with a dewaxing catalyst containing a crystalline, intermediate pore size molecular sieve selected from the group of metallosilicates and silicoaluminophosphates and having a pore diameter in the range of 0.5 to 0.7 nm, in a hydrodewaxing zone under conditions of elevated temperature and pressure, and (c) recovering the middle distillate product having a reduced wax content.

DESCRIPTION OF PREFERRED EMBODIMENTS

Examples of feedstocks suitable for use in the process according to the invention include waxy raffinates, waxy gasoils, waxy distillates, and waxy products from thermal and catalytic cracking operations. Generally, these feedstocks contain of from 2 to 20 wt. % of wax and have their pour points in the range of 0° to 55° C. The boiling ranges of these feedstocks usually are such that a substantial proportion of the feedstock, i.e., at least 20 wt. %, boils above 343° C. The boiling ranges mostly are in the range of 180° to 600° C.

If the feedstock contains objectionably large quantities of sulphur and/or nitrogen, it may be subjected to a conventional hydrodesulphurisation/hydrodenitrogenation using a hydrotreating catalyst which will normally comprise Group VIB and Group VIII metal components on a porous inorganic refractory oxide support, prior to being passed to the hydrocracking zone. As circumstances require, such a hydrotreatment step may be carried out separately, with the formed hydrogen sulphide and/or ammonia being removed from the effluent, or else the entire effluent may be fed from the hydrotreatment zone to the hydrocracking zone.

The feedstock stream is fed to the hydrocracking zone, where, in the presence of hydrogen, it is contacted with the hydrocracking catalyst. In general, the temperature in this zone is in the range of 260° to 455° C., preferably in the range of 315° to 427° C.; the total pressure usually is in the range of 3 to 21 MPa, preferably in the range of 5 to 15 MPa; the liquid hourly space velocity (LHSV) commonly is in the range of 0.3 to 8, preferably in the range of 0.5 to 3; and the hydrogen flow rate generally is higher than 89 $m^3/m^3$ of feedstock, preferably between 265 and 1780 $m^3/m^3$.

Use may be made of all hydrocracking catalysts which contain a large pore zeolite having a pore diameter in the range of 0.7 to 1.5 nm, oxygen atoms, and which catalysts are known to be suitable for use in producing middle distillates.

The suitable carrier materials in such catalysts include alumina, silica-alumina, dispersions of silica-alumina in alumina, titania-alumina, tin oxide-alumina, and aluminophosphate.

The suitable hydrogenation metal component is selected from the metals, oxides, and sulphides of the Group VIB and Group VIII elements. The most suitable metal component is selected from the group consisting of the metals, oxides, and sulphides of platinum, palladium, nickel, cobalt, molybdenum, and tungsten; in addition, combinations of these metal components may be employed, in particular nickel and tungsten, cobalt and molybdenum, and nickel and molybdenum components. The amount of metal component in the hydrocracking catalyst generally is in the range of 0.2 to 2.0 wt. % when a noble metal is employed (calculated on the basis of the metal); if Group VIB and Group VIII metals are used, they are used in amounts in the successive ranges of 5 to 30 wt. % and 0.5 to 15 wt. %, calculated as trioxide and oxide, respectively.

If desired, the catalyst may also contain a phosphorus component; it will be clear to the skilled person that one convenient way of introducing such a phosphorus component into the catalyst is to incorporate an appropriate amount of a phosphorus-containing compound, such as phosphoric acid, into an impregnation solution containing a precursor or precursors of the one or more hydrogenation metal components.

Suitable large pore zeolites include zeolite X, zeolite Y, zeolite L, zeolite omega, ZSM-4, zeolite beta, mordenite, and modifications thereof. The pore diameter of these zeolites is in the range of 0.7 to 1.5 nm, with the preferred range being 0.7 to 1.2 nm.

Preferred among these zeolites are zeolite Y and modifications thereof, that is, Y type zeolites having a unit cell size in the range of 2.420 to 2.475 nm and a silica:alumina molar ratio of from 3.5 to 100.

The suitable Y type zeolite is exemplified by the Y zeolite itself, which is a zeolite having a unit cell size in the range of 2.452 to 2.475 nm and a silica:alumina molar ratio in the range of 3.5 to about 7; for a description of this zeolite reference is made to U.S. Pat. No. 3,130,007. Other examples include ultra-stabilised Y zeolites prepared by subjecting a Y zeolite to one or more (steam) calcinations combined with one or more ammonium ion exchanges. The latter zeolites have a unit cell size of between 2.420 and about 2.455 nm and a silica:alumina molar ratio in the lattice of up to 100, preferably up to 60. For a description of such ultrastable Y zeolites reference is made to U.S. Pat. Nos. 3,293,192, 3,449,070, and 3,929,672. Such ultrastable Y zeolites are also commercially available under such trade designations as LZY-82 (prepared in accordance with U.S. Pat. No. 3,929,672) and LZ-10 (both manufactured by Union Carbide Corporation/UOP); LZ-10 is a modified Y zeolite which has a silica:alumina ratio in the range of 3.5 to 6, a surface area in the range of 500 to 700 $m^2/g$, a unit cell size in the range of 2.425 to 2.435 nm, a water adsorption capacity of less than 8 wt. % at 25° C. and a water pressure of 4.6 mm Hg, and less than 20% of the ion exchange capacity of an unmodified Y zeolite of the same silica:alumina ratio. Another suitable ultrastable Y zeolite is the one described in GB 2,114,594; its preparation also involves a combination of ammonium exchange and steam calcination, but instead of the steam calcined zeolite being further exchanged with ammonium ions, it is leached with an organic chelating agent, such as EDTA, or an organic or inorganic acid to remove extra-framework alumina. Yet another suitable ultrastable Y zeolite may-be obtained by treating a Y zeolite with diammonium hexafluorosilicate in the manner disclosed in U.S. Pat. No. 4,503,023; these zeolites, which are known by the designation LZ-210, are also available from Union Carbide Corporation/UOP and have a unit cell size in the range of 2.420 to 2.455 nm and a silica:alumina molar ratio (SAR) in the lattice in the range of 8 to 60.

When used in its acidic form, the Y type zeolite has a sodium oxide content which is generally less than 0.5 wt. %, preferably less than 0.2 wt. %.

The amount of large pore zeolite in the hydrocracking catalyst composition usually is in the range of 5 to 50 wt. %. The preparation of the hydrocracking catalyst composition may be carried out in the usual manner, including well-known comulling, extruding, calcination, and impregnation techniques.

The entire effluent from the hydrocracking zone is passed to a hydrodewaxing zone, where, in the presence of hydrogen, it is contacted with a dewaxing catalyst. Generally, the temperature in this zone is in the range of 260° to 455° C., preferably in the range of 315° to 427° C.; the total pressure usually is between 3 and 21 MPa, preferably between 5 and 15 MPa; the liquid hourly space velocity commonly is of from 0.3 to 10, preferably of from 0.5 to 5, while the hydrogen flow rate generally is above 89 $m^3/m^3$ of feedstock, preferably between 265 and 1780 $m^3/m^3$.

The essential component of the dewaxing catalyst is a crystalline, intermediate pore size molecular sieve having a pore diameter in the range of 0.5 to 0.7 nm, selected from the group of metallosilicates and silicoaluminophosphates. Such molecular sieves can also be characterized by means of the Constraint Index, which will have a value in the range of 1 to 12. The Constraint Index is indicative of the shape selective properties of the zeolite; for its determination reference is made to U.S. Pat. Nos. 4,016,218, 4,711,710, and 4,872,968. Frequently, the pores of these materials are defined by 10-membered rings of oxygen atoms.

Useful metallosilicates include borosilicates (as described, for example, in EP-A 0,279,180), iron silicates (as described, for example, in U.S. Pat. No. 4,961,836) and aluminosilicates. Useful silicoaluminophosphates include SAPO-11, SAPO-31, SAPO-34, SAPO-40, and SAPO-41, with SAPO-11 being preferred; for a description of several of these silicoaluminophosphates reference is made to U.S. Pat. No. 4,440,871.

Also preferred are the aluminosilicates. Examples of these include TMA-offretite (described in *Journal of Catalysis,* 86 (1984):24–31), ZSM-5 (described in U.S. Pat. No. 3,702,886), ZSM-11 (described in U.S. Pat. No. 3,709,979), ZSM-12 (described in U.S. Pat. No. 3,823,449), ZSM-23 (described in U.S. Pat. No. 4,076,842), ZSM-35 (described in U.S. Pat. No. 4,016,245), and ZSM-38 (described in U.S. Pat. No. 4,046,859). Preference is given to ZSM-5. The silica:alumina molar ratio may be in the range of 12 to 500, with ratios in the range of 20 to 300, more particularly 30 to 250, being preferred.

The preparative process usually yields the aluminosilicates in the form of their sodium salts, and it is recommended to replace as many sodium ions as possible with hydrogen ions, e.g., by means of one or more exchanges with ammonium ions, followed by a calcination step. Next to the molecular sieve, the hydrodewaxing catalyst will usually contain a binder material in the form of a porous, inorganic refractory oxide, such as (gamma) alumina. The proportion of molecular sieve in the molecular sieve/binder composition may vary in the range of 2 to 90 wt. %.

In addition, the dewaxing catalyst may contain one or more hydrogenation metal components selected from the metals, oxides, and sulphides of the Group VIB and Group VIII metals. Incidentally, if the dewaxing catalyst contains said one or more hydrogenation metal components, it may also be referred to as a hydrodewaxing catalyst, but for the purpose of this specification the term "dewaxing catalyst" is used to designate both of these embodiments. In this context it should also be noted that throughout the specification the term "hydrodewaxing zone" has been used, irrespective of whether the dewaxing catalyst contains a hydrogenation metal component or not, this because of the presence of hydrogen in the zone.

The most suitable hydrogenation metal components are selected from the group consisting of the metals, oxides, and sulphides of platinum, palladium, nickel, the combination of nickel and tungsten, and the combination of cobalt and molybdenum. In general, the amount of these metals is of from 5 to 30 wt. % of Group VIB metal component, calculated as trioxide, and of from 0.3 to 8 wt. % of non-noble Group VIII metal component, calculated as oxide. If a noble metal is employed, the amount thereof may be in the range of 0.1 to 2 wt. %.

The preparation of the dewaxing catalyst may be carried out in an otherwise known manner by mixing the molecular sieve with a binder precursor material such as an alumina hydrogel—e.g., peptised Catapal®, peptised Versal®, or a precipitated alumina gel—extruding the mixture, and then calcining the extrudates.

If it is desired to include one or more hydrogenation metal components, conventional techniques, such as incorporating an appropriate solid or a solution containing one or more metal component precursors into the molecular sieve/binder precursor mixture prior to extrusion, or impregnating the metal-free extrudates with a solution containing one or more metal component precursors, may be employed. Also, a phosphorus component may be part of the dewaxing catalyst. One convenient way of introducing the phophorus component involves impregnating the extrudates—containing one or more hydrogenation metal components or not—with a solution containing an appropriate amount of a phopsphorus-containing compound, such as phosphoric acid. Evidently, if the catalyst is to be made to contain one or more hydrogenation metal components as well, another convenient way to introduce the phosphorus component is to include an appropriate amount of a phosphorus-containing compound, such as phosphoric acid, into an impregnation solution containing a precursor or precursors of said one or more hydrogenation metal components. In an alternative method it is contemplated to include a phosphorus-containing compound into the mixture comprising the molecular sieve and the binder precursor prior to the extrusion step.

The reaction conditions (temperature, pressure, LHSV, and hydrogen partial pressure) in the hydrocracking and hydrodewaxing zones may be identical, but this is not required. The total pressure and the hydrogen flow rate in general will be the same, the LHSV for the two catalyst beds collectively may vary in the ratio range of 0.2 to 5, and the temperature difference between the two catalyst beds normally does not exceed 50° C.

In order to obtain the best possible effect with the process according to the invention the reaction conditions of the two zones must be carefully selected to provide the desired conversion rates and low pour point, cloud point, and/or freeze point, depending on the circumstances, while minimising the conversion to undesired lower-boiling products. Generally, the optimum reaction conditions will depend on the activity of the catalysts, the nature of the feedstock, and the desired balance between conversion and selectivity, which are inversely correlated. Higher conversion will generally result in lower selectivity. The optimisation of the reaction conditions is well within the scope of the artisan's skill.

Preferably, the reaction conditions in the two zones are so selected or matched that a product is obtained of which a substantial proportion, preferably over 50 wt. %, has a boiling point below 371° C., more specifically, between 149° and 371° C. in the middle distilate range.

In commercial practice it is often desirable to minimise the amount of product boiling below the middle distillate range. In those cases it is preferable to select the reaction conditions such that the overall conversion of feedstock constituents into product components boiling at or below 149° C. is not more than 50 wt. %, preferably not more than 30 wt. %, most preferably not more than 20 wt. %.

Optionally, the hydrodewaxing zone product, or a portion of it, may be subjected to catalytic hydroprocessing, that is, hydrogenation and/or mild hydrocracking. This may be done by passing the entire effluent from the hydrodewaxing zone over a hydroprocessing catalyst bed arranged in a hydroprocessing zone situated downstream of the hydrodewaxing zone. Alternatively, one may pass only a part of said effluent over the downstream hydroprocessing catalyst, the remainder being sent to the middle distillate recovery unit. Alternatively, the product stream to be hydroprocessed may be deprived of its gaseous components, notably hydrogen sulphide and/or ammonia, after which fresh hydrogen is added prior to the hydroprocessing step.

Typical hydroprocessing conditions include a temperature in the range of 260° to 455° C., preferably 260 to 380° C., a total pressure in the range of 2 to 21 MPa, a liquid hourly space velocity in the range of 0.3 to 8, and a hydrogen flow rate higher than 89 $m^3/m^3$, preferably in the range of 100 to 2000 $m^3/m^3$. Normally, the hydroprocessing catalyst will comprise a porous inorganic refractory oxide support, such as alumina, silica-alumina, or silica-alumina dispersed in alumina, and at least one metal component selected from Group VIB and Group VIII including the noble metals.

Such an after-treatment may be of advantage if a product is desired which has to meet certain requirements with regard to, for example, cetane index and/or oxidation stability under the influence of ultraviolet light and it is found that the product obtained after hydrocracking and dewaxing according to the invention fails to meet these requirements. Such a situation may arise, say, if in the hydrodewaxing zone use is made of a catalyst which does not contain a hydrogenation metal component or hydrogenation metal components, but even when it does, the amount of these metal components and/or the severity of the process conditions may prove insufficient to effect the hydrogenation of unsaturated compounds needed to obtain the required cetane index and/or oxidation stability.

The effluent from the hydrodewaxing zone, or from the subsequent hydroprocessing zone if the hydrodewaxing zone effluent, or a part of it, has been subjected to subsequent hydroprocessing, has a strongly decreased wax content, and as stated above, a substantial proportion of it boils below 371° C. The desired product is recovered from the effluent, if need be by fractionation. If the desired product is a jet fuel, it will normally boil between about 149° and about 288° C. and have a relatively low freeze point, typically below −40° C., and preferably below −60° C. If the desired product is a diesel fuel or a heating oil, it will typically boil between about 200° and 371° C., or between about 288° and 371° C. (depending on product specification) and have a relatively low pour point and a relatively low cloud point, typically below 50° C.

The following Examples illustrate the invention.

In the Examples, the cloud points are determined in accordance with ASTM D2500, the pour points are determined in accordance with ASTM D97, the bromine index is determined in accordance with ASTM D2710, and the cetane index is determined in accordance with ASTM D976.

EXAMPLE 1

A feedstock the characteristics of which are given in Table 1 was hydrocracked and dewaxed in accordance with the process of the invention.

The first catalyst bed consisted of a hydrocracking catalyst containing 4.2 wt. % of cobalt component (calculated as CoO), 24 wt. % of a molybdenum component (calculated as $MoO_3$) impregnated on extrudates consisting of 10 wt. % of LZ-10 in the hydrogen form and 90 wt. % of alumina; prior to use, the catalyst was presulphided using a mixture of hydrogen and hydrogen sulphide under conventional temperature programming conditions.

The second catalyst bed consisted of a dewaxing catalyst containing 40 wt. % of an alumina carrier and 60 wt. % of SAPO-11 silicoaluminophosphate. The flow in the reactor was from the top downwards. The volume ratio of the first to the second catalyst bed was 7:3. The entire effluent from the first bed was passed to the second bed.

The operating conditions as well as the results are listed in Table 2.

TABLE 1

| Feedstock inspection | |
|---|---|
| Specific gravity (15/4° C.) | 0.871 |
| Sulphur (wt. %) | 0.51 |
| Nitrogen | |
| - basic (ppm) | 190 |
| - total (ppm) | 632 |
| Cloud point (° C.) | 30 |
| Pour point (° C.) | 27 |
| ASTM Distillation (° C.) D1160 | |
| IBP | 245 |
| 10% (vol) | 336 |
| 30 | 363 |
| 50 | 378 |
| 70 | 390 |
| 90 | 409 |
| FBP | 426 |

TABLE 2

| Operating conditions and test results | |
|---|---|
| Operating conditions: | |
| Total LHSV | 0.5 |
| Total pressure | 6 MPa |

TABLE 2-continued

| Operating conditions and test results | |
|---|---|
| Temperature | 380° C. |
| $H_2$/HC | 500 Nl/l |
| 180° C. + product properties: | |
| Specific gravity (15/4° C.) | 0.84 |
| Sulphur (ppm) | 40 |
| Pour point (° C.) | −30 |
| Cloud point (° C.) | −30 |
| Cetane index | 58.4 |
| Bromine number | <2 |
| ASTM D86 Distillation of 180 + product (° C.) | |
| IBP | 201 |
| 5% (vol.) | 216 |
| 10 | 220 |
| 30 | 246 |
| 50 | 294 |
| 70 | 343 |
| 90 | 375 |
| 95 | —° |
| FBP | —° |

° could not be determined

EXAMPLE 2

This example serves to illustrate how the process according to the invention, in which a feedstock is first contacted with a hydrocracking catalyst and subsequently contacted with a dewaxing catalyst, constitutes an improvement over the process according to U.S. Pat. No. 4,743,354, in which a feedstock is first contacted with a dewaxing catalyst and subsequently with a hydrocracking catalyst.

The hydrocracking catalyst carrier was prepared by extruding a mixture of 12 750 grams of a commercially available dealuminated Y-zeolite with an $a_o$ of 2.430 nm (ex PQ zeolites) (Loss on ignition (LOI) 37.6%), 82 300 grams of pseudoboehmite alumina (LOI 27.1%), 54 710 grams of silica-alumina (25 wt. % alumina, LOI 13.7%), 11.56 1 54% $HN0_3$ and 122.5 1 water. The extrudates were dried at 120° C., and subsequently calcined in air for 1 hour at 550° C.

10 kg of the calcined carrier were impregnated with an impregnation solution comprising ammonium metatungstate and nickel nitrate, after which the impregnated particles were dried and calcined in flowing air at 550° C. The final catalyst comprised 3.8 wt. % of nickel component (calculated as NiO), 23.1 wt. % of tungsten component (calculated as $WO_3$), 5.2 wt. % of Y-zeolite, 28 wt. % of silica-alumina, and the balance alumina.

The dewaxing catalyst carrier was prepared by mixing 5150 grams of ZSM-5 with a silica:alumina molar ratio (SAR) of 40 (LOI 3%), prepared as described is U.S. Pat. No. 3,702,886 with 6860 grams pseudoboehmite alumina (LOI 27.1%), adding enough diluted $HNO_3$ to peptise part of the alumina, extruding the obtained mixture, drying the extrudates at 120° C., and calcining the dried extrudates in air for 1 hour at 450° C. Nickel and tungsten were incorporated into the catalyst in the same manner as described above for the hydrocracking catalyst. The final catalyst comprised 0.7 wt. % of nickel component (calculated as NiO), 15.3 wt. % of tungsten component (calculated as $WO_3$), and 42 wt. % of ZSM-5.

The properties of the feedstock used in this example are given in Table 3.

TABLE 3

| Feedstock inspection | |
|---|---|
| Specific gravity (15/4° C.) | : 0.8589 |
| Sulphur (wt. %) | : 0.5447 |
| Nitrogen | |
| - basic (ppm) | : 20 |
| - total (ppm) | : 21 |
| Cloud point (° C.) | : 26 |
| Pour point (° C.) | : 24 |
| ASTM Distillation (° C.) D1160 | |
| IBP | : 282 |
| 5% (vol) | : 346 |
| 10 | : 360 |
| 20 | : 374 |
| 30 | : 390 |
| 40 | : 398 |
| 50 | : 406 |
| 60 | : 414 |
| 70 | : 423 |
| 80 | : 431 |
| 90 | : 443 |
| 95 | : 451 |
| DSC° paraffins | |
| Cloud point (° C.) | :23.1 |
| Paraffins at 18.1° C. (wt. %) | : 3.45 |
| Paraffins at 13.1° C. (wt. %) | : 5.72 |
| Paraffins at 8.1° C. (wt. %) | : 7.77 |
| Paraffins at 3.1° C. (wt. %) | : 9.66 |
| Paraffins at −13.1° C. (wt. %) | :14.8 |
| Paraffins at −60° C. (wt. %) | :27.34 |

° DSC stands for Differential Scanning Calorimetry, which is a method for determining the amount of solid paraffins in a sample at a certain temperature.

Two runs were performed, one according to the invention, in which the feed was first contacted with the hydrocracking catalyst and subsequently with the dewaxing catalyst, and the other according to U.S. Pat. No. 4,743,354, in which the feedstock was first contacted with the dewaxing catalyst and subsequently with the hydrocracking catalyst. The flow in the reactor was from the top downwards. In both cases, the total catalyst bed comprised 70 wt. % of hydrocracking catalyst and 30 wt. % of dewaxing catalyst. The entire effluent from the first bed was passed to the second bed. With both sets of catalysts runs were first performed at 370° C. and subsequently at 360° C., use being made of the same catalysts.

The operating conditions as well as the results are listed in Table 4.

TABLE 4

| Operating conditions and test results | | | | |
|---|---|---|---|---|
| Operating conditions: | | | | |
| Total LHSV | 0.5 | | | |
| Total pressure | 6 MPa | | | |
| Temperature | 360° and 370° C. | | | |
| $H_2$/HC | 500 Nl/l | | | |
| | 360° C. | | 370° C. | |
| Product | HC→DW (i) | DW→HC (c) | HC→DW (i) | DW→HC (c) |
| 180° C. + product properties: | | | | |
| Dens. at 15° C. (g/ml) | 0.8045 | 0.8181 | 0.8056 | 0.8129 |
| Sulphur (ppm) | 26 | 15 | 42 | 76 |
| Pour point (° C.) | <−57 | −21 | <−57 | −39 |

TABLE 4-continued

| Operating conditions and test results | | | | |
|---|---|---|---|---|
| Cloud point (° C.) | <−59 | −3 | <−59 | −44 |
| Bromine index | 333 | 70 | 95.9 | 434 |
| Cetane index | 58.2 | 58.2 | 54.4 | 55.6 |
| Distillation ASTM D86 of 180 + product (° C.) | | | | |
| IBP | 196 | 202 | 187 | 190 |
| 5 (vol. %) | 210 | 212 | 199 | 211 |
| 10 | 212 | 215 | 202 | 215 |
| 20 | 216 | 222 | 208 | 218 |
| 30 | 222 | 232 | 213 | 227 |
| 40 | 231 | 246 | 224 | 235 |
| 50 | 244 | 266 | 234 | 245 |
| 60 | 261 | 294 | 252 | 263 |
| 70 | 284 | 324 | 277 | 283 |
| 80 | 314 | 359 | 312 | 314 |
| 90 | 349 | —° | 353 | 356 |
| 95 | 365 | —° | 368 | 379 |
| FBP | 367 | —° | 382 | —° |

° could not be determined

In this table, (i) stands for an experiment according to the invention, while (c) stands for a comparative experiment according to U.S. Pat. No. 4,743,354.

As can be seen from Table 4, both at 360° and at 370° C. the pour point and the cloud point of the product obtained with the process according to the invention are substantially lower than those of the product obtained with the comparative process.

We claim:

1. A process for converting a wax-containing hydrocarbon feedstock containing a substantial proportion of hydrocarbonaceous material boiling above 343° C. into a middle distillate product having a reduced wax content compared to that of the feedstock, which process comprises:

(a) contacting the feedstock in the presence of hydrogen with a hydrocracking catalyst containing a carrier, at least one hydrogenation metal component selected from Group VIB and Group VIII of the Periodic Table, and a large pore zeolite that is a Y type zeolite having a pore diameter in the range of 0.7 to 1.5 nm, in a hydrocracking zone under conditions of elevated temperature and pressure, (b) contacting the entire effluent from the hydrocracking zone in the presence of hydrogen with a dewaxing catalyst containing a crystalline, intermediate pore size molecular sieve selected from the group of metallosilicates and silicoaluminophosphates and having a pore diameter in the range of 0.5 to 0.7 nm, in a hydrodewaxing zone under conditions of elevated temperate and pressure, and (c) recovering the middle distillate product having a reduced wax content.

2. A process according to claim 1, wherein the molecular sieve in the dewaxing catalyst is a ZSM-5 zeolite.

3. A process according to claim 1, wherein the dewaxing catalyst contains at least one hydrogenation metal component selected from Group VIB and Group VIII.

4. A process according to claim 1, wherein prior to the middle distillate product of reduced wax content being recovered, at least part of the liquid effluent from the hydrodewaxing zone is contacted in the presence of hydrogen with a hydroprocessing catalyst containing a carrier and at least one metal component selected from the metals of Group VIB and Group VIII, in a hydroprocessing zone under conditions of elevated temperature and pressure.

5. A process according to claim 1, wherein the conditions of elevated temperature and pressure, which may be different at each step, comprise a temperature in the range of from 260° to 455° C. and a pressure between 3 and 21 MPa.

* * * * *